US009382065B2

(12) United States Patent
Gallacher

(10) Patent No.: US 9,382,065 B2
(45) Date of Patent: Jul. 5, 2016

(54) BULK STORAGE CONTAINER AND BULK MATERIAL HANDLING ASSEMBLY THEREWITH

(71) Applicant: Dialog Construction Sdn. Bhd., Petaling Jaya, Selangor Darul Ehsap (MY)

(72) Inventor: Philip Gallacher, Petaling Jaya (MY)

(73) Assignee: DIALOG CONSTRUCTION SDN. BHD., Petaling Jaya (MY)

( * ) Notice: Subject to any disclaimer, the term of this patent is extended or adjusted under 35 U.S.C. 154(b) by 0 days.

(21) Appl. No.: 14/396,757

(22) PCT Filed: Apr. 24, 2013

(86) PCT No.: PCT/MY2013/000090

§ 371 (c)(1),
(2) Date: Oct. 24, 2014

(87) PCT Pub. No.: WO2013/162352

PCT Pub. Date: Oct. 31, 2013

(65) Prior Publication Data

US 2015/0114996 A1 Apr. 30, 2015

(30) Foreign Application Priority Data

Apr. 27, 2012 (MY) ..... PI 2012001899

(51) Int. Cl.
*B65D 88/08* (2006.01)
*B65D 88/12* (2006.01)
(Continued)

(52) U.S. Cl.
CPC . *B65D 88/08* (2013.01); *B65B 1/28* (2013.01); *B65B 31/04* (2013.01); *B65D 88/126* (2013.01);
(Continued)

(58) Field of Classification Search
CPC ..... B65D 88/08; B65D 88/26; B65D 88/30; B65D 88/54; B65D 88/126; B65D 88/745; B65D 90/14; B65B 1/28; B65B 31/04; B65B 69/0075; B65B 69/0091; B65B 69/183
See application file for complete search history.

(56) References Cited

U.S. PATENT DOCUMENTS 4,836,421 A 6/1989 Miyoshi et al. ..... 222/166
4,966,311 A * 10/1990 Taylor ..... B65B 69/0091 222/105

(Continued)

FOREIGN PATENT DOCUMENTS

DE 349 157 2/1922
DE 595 796 4/1934

(Continued)

OTHER PUBLICATIONS

International Search Report for International Application No. PCT/MY2013/000090, Nov. 25, 2013.

(Continued)

*Primary Examiner* — Frederick C Nicolas
(74) *Attorney, Agent, or Firm* — Pearne & Gordon LLP

(57) ABSTRACT

An intermediate bulk storage container for the storage or transport of particulate catalyst material includes a vessel having an inner wall defining a containment volume for particulate catalyst material. The vessel has a cylindrical wall section, a top panel closing the upper end of the cylindrical wall section and a conical base section connected to and tapering inwardly away from the lower end of the cylindrical wall section. An opening in the top panel of the container receives the catalyst material and a closure member closes the opening. An air tight seal is formed when the opening is closed by the closure member. A gas duct is in fluid connection with the vessel for supplying an inert gas to the sealed container or removing gas from the vessel to place the container under a vacuum. The gas duct is closed by a valve for transit or storage.

5 Claims, 2 Drawing Sheets

(51) Int. Cl.

| | |
|---|---|
| ***B65D 88/26*** | (2006.01) |
| ***B65D 88/54*** | (2006.01) |
| ***B65D 90/14*** | (2006.01) |
| ***B65D 88/30*** | (2006.01) |
| ***B65B 1/28*** | (2006.01) |
| ***B65B 31/04*** | (2006.01) |
| *B65B 69/00* | (2006.01) |
| *B65D 88/74* | (2006.01) |

(52) U.S. Cl.
CPC ..... *B65D 88/26* (2013.01); *B65D 88/30* (2013.01); *B65D 88/54* (2013.01); *B65D 90/14* (2013.01); *B65B 69/0075* (2013.01); *B65B 69/0091* (2013.01); *B65D 88/745* (2013.01)

(56) References Cited

U.S. PATENT DOCUMENTS

| | | | | |
|---|---|---|---|---|
| 5,341,959 | A * | 8/1994 | Ellis | B65G 69/183 222/105 |
| 5,531,360 | A * | 7/1996 | Berdel | B65B 69/0091 206/386 |
| 6,340,100 | B1 * | 1/2002 | Gill | B65B 69/0075 141/315 |
| 6,484,764 | B1 * | 11/2002 | Wegman | B65B 1/12 141/256 |
| 2003/0075238 | A1 * | 4/2003 | Doerffel | B65G 69/182 141/286 |

FOREIGN PATENT DOCUMENTS

| | | | |
|---|---|---|---|
| EP | 1 790 570 | 5/2007 | B65B 31/00 |
| GB | 2 440 401 | 1/2008 | B65G 69/18 |
| WO | WO 02/090194 | 11/2002 | |
| WO | WO 03/089346 | 10/2003 | B65G 53/22 |
| WO | WO 2011/088493 | 7/2011 | E21B 21/01 |
| WO | WO 2012/013803 | 2/2012 | B65D 88/12 |

OTHER PUBLICATIONS

Written Opinion of the International Searching Authority for International Application No. PCT/MY2013/000090, Nov. 25, 2013.

* cited by examiner

BULK STORAGE CONTAINER AND BULK MATERIAL HANDLING ASSEMBLY THEREWITH

TECHNICAL FIELD

The present invention relates to a bulk storage container for use in storing and transporting bulk material, and in particular to a bulk material container for storing particulate catalyst material.

BACKGROUND

Large scale chemical processing plants utilise catalyst material to improve reactor efficiencies and increase output. Catalyst material, which is typically in the form of catalyst pellets, has a finite process life and eventually requires re-processing or replacing. Therefore vessels are required for the delivery of catalyst material to a reactor, as well as the storage and transport of material during the removal or re-processing of the material. Containers often used for this purpose are referred to as intermediate bulk containers or IBC's.

IBC's typically comprise a rigid metal container, square in cross-section and having an entry opening at the top through which the container is filled. To fill the IBC a chute or spout is commonly used which relies on gravity feed. As the IBC is filled, the bulk catalyst material displaces the air large within the container and large amounts of dust from the catalyst material become entrained within the air. This dust is emitted in an uncontrolled manner through the top opening of the container. The inhalation or ingestion dust from a catalyst material presents a serious health hazard, with many catalyst materials being toxic and also potentially containing carcinogenic substances.

It is therefore desirable to provide an improved bulk storage container which addresses the above described problems and/or which offers improvements generally.

According to the present invention there is provided a bulk storage container as described in the accompanying claims. In addition there is provided a bulk material handling assembly according to the accompanying claims.

In an embodiment of the invention there is provided a bulk storage container for particulate material comprising a vessel having an inner wall defining a containment volume for particulate material; an opening for receiving said particulate material into the vessel; a closure member for closing the opening; sealing means for sealing the opening when closed by the closure member; a gas duct in fluid connection with the vessel for supplying gas to or removing gas from the vessel; and a valve for closing the gas duct to seal the container for transit or storage.

The vessel may comprise a cylindrical wall section, a top panel closing the upper end of the cylindrical wall section and a conical base section connected to and tapering inwardly away from the lower end of the cylindrical wall section, and wherein the opening is defined in the upper panel and a secondary opening defining an outlet is provided at the tapered end of the base section the includes a secondary closure member which is movable to an open position to permit removal of the particulate material from the vessel.

The bulk storage container may further comprise secondary sealing means for sealing the secondary opening in the closed position.

The bulk storage container may further comprise an outlet vent configured to permit air to purged from the vessel when a gas is supplied into the vessel via the gas duct.

The outlet vent preferably comprised a unidirectional valve.

In another aspect of the invention there is provided a bulk material handling assembly for transferring particulate material to a storage container for transport or storage, the assembly comprising a bulk storage container as described above; a feeder vessel from which the container is filled; a filling duct for connecting the feeder vessel to the container; sealing means configured to provide a seal between the feeder duct and the container about the opening of the container to prevent the release of particulate material from the opening during filling; and a vacuum source connected to the gas duct of the container to remove gas from the sealed container during filling and to evacuate gas from the container when opening closed and sealed for transit or storage.

The feeder vessel preferably comprises a hopper having an opening in its base to the filling duct is connected and an entry port configured to permit the hopper to filled with particulate material entrained within a carrier gas flow; and a gas extraction duct in fluid connection with the interior of the hopper and connected to the vacuum to promote the flow of gas into the hopper.

The bulk material handling assembly may further comprise a dust extractor, the dust extractor comprising an annular collar surrounding the filling duct such that a void is defined between the inner wall of the collar and the filling duct; a dust extraction duct in fluid connection with the void between said filling duct and inner periphery of said collar and connected to the vacuum source to facilitate the application of a vacuum to said void; and a valve arrangement configured to selectively switch the application of said vacuum between the gas extraction duct in fluid connection with the interior of the hopper and the dust extraction duct connected to the annular collar such that the vacuum is applied to the collar and not the hopper when the particulate material is being transferred from the hopper to the container via the filling duct.

The valve means comprises a first valve arranged to close the fluid connection between the hopper and the vacuum source and a second valve arranged to close the fluid connection between the annular collar and the vacuum source.

The valve means may be re-configurable between a first operating condition in which the first diverter valve is open permitting the application of suction to the hopper via the suction pipe and the second diverter valve is closed, and a second operating condition in which the first diverter valve is closed and the second diverter valve is open permitting the application of suction to the annular collar.

DESCRIPTION OF DRAWINGS

Embodiments of the present invention will now be described by way of examples only and with reference to the accompanying drawings, in which.

DETAILED DESCRIPTION

Figure 1:
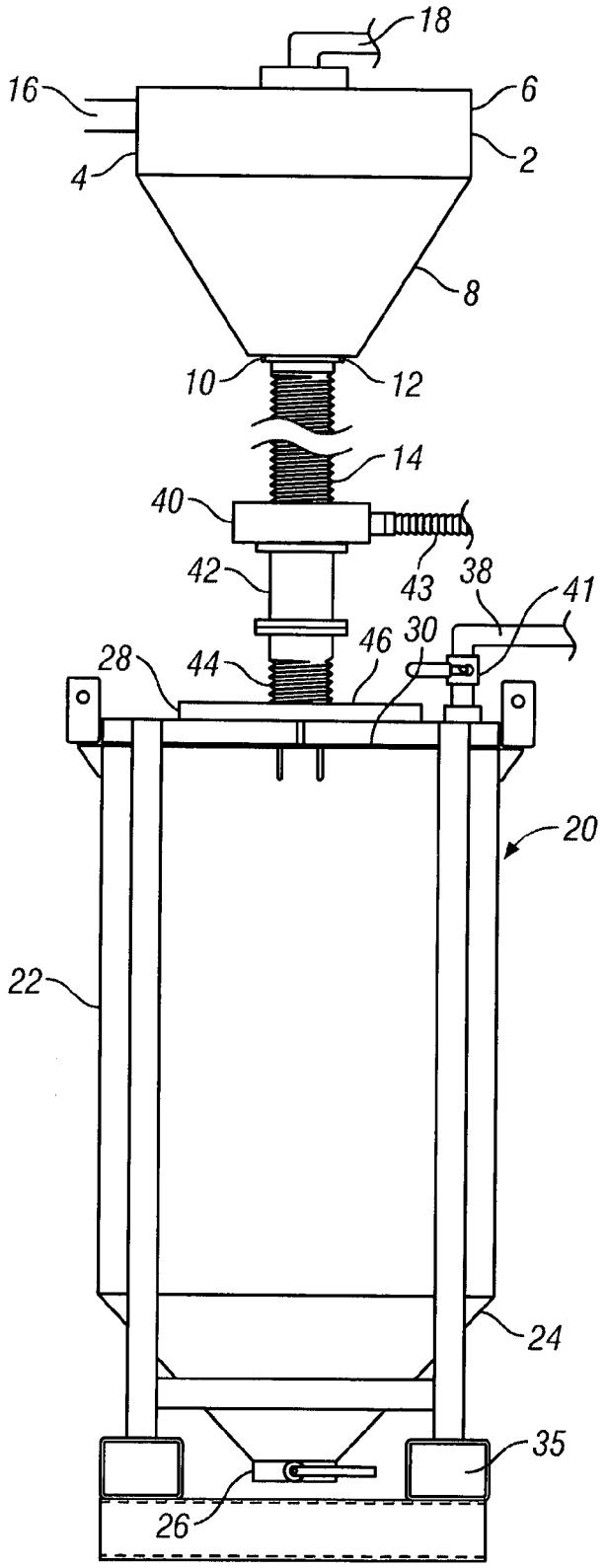
FIG. 1 shows a bulk material handling assembly according to an embodiment of the invention.
Figure 2:
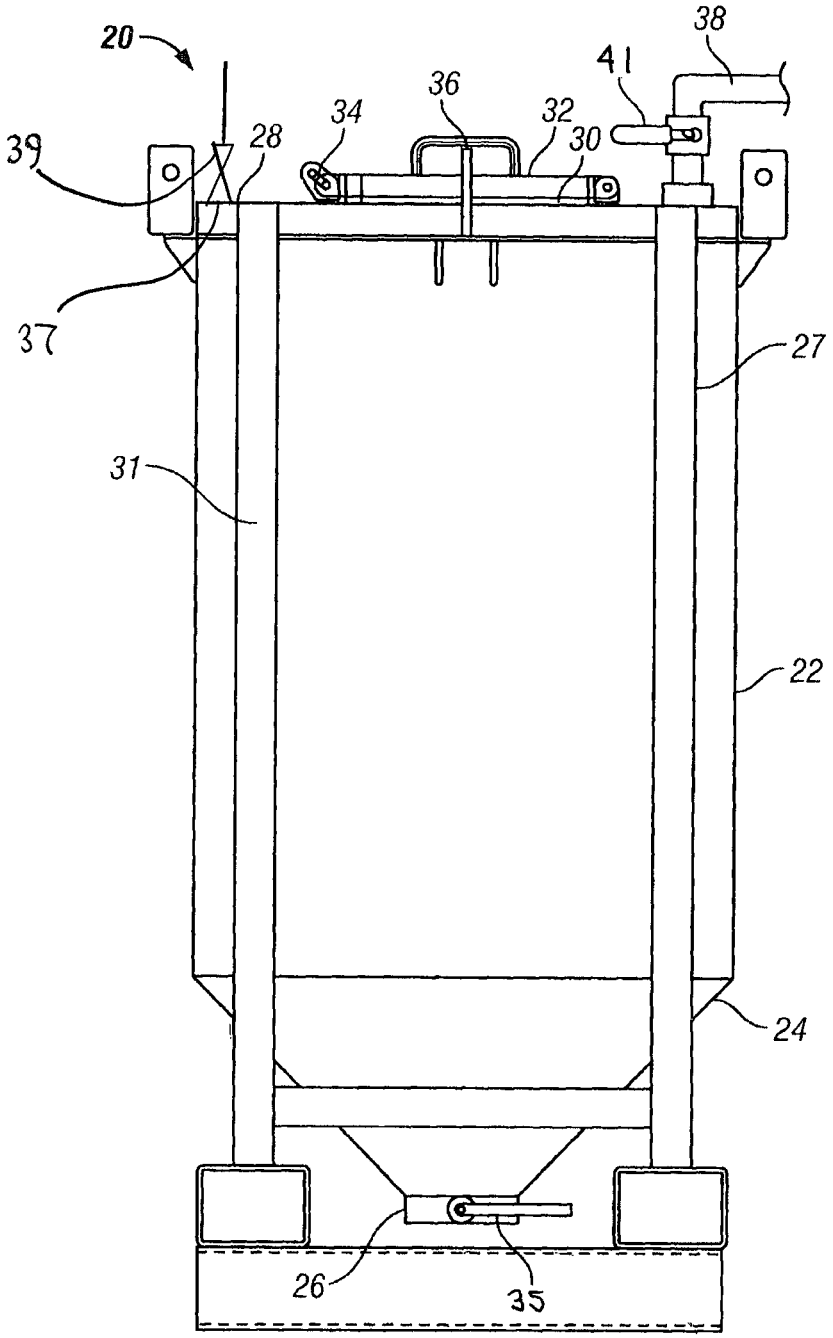
FIG. 2 shows a intermediate bulk material container according to an embodiment of the invention.

Referring to FIG. 1 a bulk material loading apparatus 1 is provided for transferring particulate catalyst material from a vessel within a reactor to a bulk material container for transport away from the reactor and/or storage. The loading apparatus comprises an intermediate hopper 2, also know as an interceptor hopper, that receives catalyst material the reactor vessel and transfers it onwards to the bulk material container.

A vacuum is used to draw the bulk catalyst material out of the reactor vessel, and this material is entrained in the gas flow and transferred to the interceptor hopper 2 under vacuum.

The interceptor hopper 2 comprises a vessel body 4 having a typical hopper configuration with a cylindrical upper portion 6 and a conical lower portion 8 tapering towards an opening 10 at its base. The interceptor hopper 2 is supported by a sub-frame (not shown) that holds the hopper in an elevated position. A slide valve 12 is provided for opening and closing the opening 10. A flexible tubular outlet duct 14 is connected to the opening 10 of the hopper 2. An inlet port 16 extends into the top part of the hopper 2 tangentially through its side wall through which the catalyst material is transferred into the hopper 2 entrained in the inlet gas. A suction duct 18 extends from the top of the hopper 2 and is connected to a vacuum source (not shown). A first diverter valve (not shown) is provided which selectively opens and closes the suction duct 18.

The bulk catalyst material is transferred from the hopper 2 to a bulk intermediate material container 20. The container 20 comprises a main body section 22 which is rigid metal substantially cylindrical section. The container 20 further includes a conical base section 22 which is contiguous with the cylindrical section 22 and which tapers inwardly away from the cylindrical section 22 towards an opening 26 at its base. The container 20 is supported by a frame 27 including a base 29, a plurality of upright members 31 and cross members 33 interconnecting the upright members 31 proximate the base 29. The base 29 is configured to receive the tines of a forklift truck with slots 35 to enable the container 20 to be lifted. The container 20 is secured by welding or other means to the frame 27.

The top 28 of the cylindrical section 22 of the container 20 is closed by a top panel having an opening aperture 30 defined substantially centrally therein. A lid 32 closes the opening 30. The lid 32 is pivoted about hinges 34 and includes locking means 36 provided about its periphery for locking it in the closed position and a seal for sealing the opening when the lid 32 is closed. A gas duct 38 is connected to the upper panel 28 and comprises an outlet pipe in fluid connection with the interior of the container 20. The gas duct 38 includes a valve 41 for selectively opening and closing the duct. The valve 41 is preferably a manual lever valve but could be any suitable valve means for closing the duct 38. The duct 38 is configured to facilitate gas flow into and out of the container 20. In a preferred embodiment the duct is connected to the vacuum source.

The opening 26 are the base 24 of the container 20 is provided with a closure 35 which is preferably in the form of a slide which is pulled outwardly in order to uncover the opening for unloading the container. The slide plate 35 may be manually operated and/or hydraulically actuated.

A filling duct extends between the hopper 2 and the container 20 which includes the upper flexible pipe 14, and intermediate rigid pipe section 42 and a lower flexible pipe section 44. The intermediate rigid pipe section 44 is secured to the frame section 27 and is aligned above the opening 30 of the container 20. The upper flexible pipe 14 connects the hopper 2 to the rigid pipe section 42, and the lower flexible pipe 44 connects the rigid pipe 42 to the opening 30. A sealing plate 46 is connected to the lower end of the lower flexible pipe 44.

The sealing plate 46 is configured to engage the upper plate 28 of the container 20 when the lid 32 is in the open position and is diametrically larger than the opening 30 such it covers and seal around the opening 30. The sealing plate is preferably locked in the sealing position against the upper surface 28 by the locking means 36 used to lock the lid 32 closed, although separate locking means may be provided.

A dust extractor is provided between the hopper 2 and the container 20. As shown in FIG. 1 the dust extractor is provided in the form of an annular collar 40 which surround the opening to the rigid pipe section 42 at the point of connection with the upper flexible pipe 14. The upper flexible pipe 14 fits into the opening of the rigid pipe section 42. A void is defined between the inner wall of the collar 40 and the flexible pipe 14 defining a chamber on the inner side of the collar 40. The chamber extends part way around the inner circumference of the collar 40, with its opposite end open. A suction pipe 43 is connected to the chamber of the collar 40. The suction pipe 43 is connected to the vacuum source to apply a vacuum to the collar to extract dust emitted from the flexible pipe 14 and/or the rigid pipe 42 during filling of the container. A second diverter valve selectively closes the suction pipe 43.

In use, to fill the container the lid 32 is opened and the sealing plate 46 is secured in position over the opening. The slide valve 12 is located in the closed position, the first diverter is opened and the second diverter valve is closed. The vacuum source is operated to suck air from inside the hopper 2 drawing the bulk material into the hopper 2 via the inlet duct 16. When the hopper 2 has been filled the slide valve 12 is opened to allow material to enter the flexible pipe 14 through the opening 10. Once the hopper 2 has been filled the is the first diverter valve is closed, the second diverter valve is opened and the slide valve 12 of the hopper 2 is opened.

With the slide valve 12 open the catalyst material flows under the force of gravity from the hopper and into the container 20 via the filling duct. The vacuum source applied to the collar 40 withdraws the air being displaced from the container 20, and also the dust entrained in this air. In addition, the valve 41 is opened and the vacuum source connected to the outlet duct 38 withdraws air displaced by the catalyst material as well as accelerating the filling process.

Once the container 20 has been filled the catalyst is allowed to settle and the sealing plate 46 is then removed. On removal of the sealing plate the vacuum within the container 20 created by the outlet 38 is temporarily lost. The vacuum may continue to be applied through the duct 38 to suppress dust loss through the opening 30 when the sealing plate 46 is removed. The lid 32 is then closed, sealed and locked in position by the locking means 36. A vacuum is then applied to the container via the outlet duct 38. A pressure meter is provided, preferably on the valve 41, which indicates the pressure within the container 20. Once a pressure indicating the residual air within the container has been removed the valve 41 is closed and the vacuum to the container 20 is shut off with the valve 41 sealing the container 20. The container 20 is then ready for transport and/or storage. With the air within the container 20 having been evacuated the risk of ignition of the catalyst material is removed. The cylindrical shape of the main body section 22 of the container 20 enable the container to withstand the negative pressure created within the container by the vacuum, in contrast to square section containers of the prior art which are not suited to withstand such pressures.

In an alternative embodiment the filling duct may connect directly to the sealing plate 46 without the provision of an intermediate dust extractor 40. In this embodiment the air displaced from the container 20 by the catalyst material filling the container is removed through the duct 38 under the action of the vacuum source connected thereto.

In yet further embodiment, rather than remove the air from the container 20 following filling, the duct 38 may be connected to a source of inert gas such as nitrogen. The nitrogen may be pumped into the container 20 through the duct 38 to displace the air within the container. A secondary outlet 37 is provided in the upper plate 28. The secondary outlet 37 preferably includes a uni-directional valve 39 to permit the exit of air from the container displaced by the inert gas. The flow of nitrogen is continued for a predetermined period until the air in the container 20 has been fully displaced. The valve 41 is then closed and the container 20 is sealed for storage containing catalyst within an inert gas, which again removes the risk of ignition within the container.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

Having described the invention, the following is claimed:

1. A bulk storage container for particulate material comprising:

a vessel having an inner wall defining a containment volume for particulate material, wherein the vessel comprises a cylindrical wall section, a top panel closing the upper end of the cylindrical wall section and a conical base section connected to and tapering inwardly away from the lower end of the cylindrical wall section, wherein an opening is defined in the top panel, the opening for receiving said particulate material into the vessel, and a secondary opening defining an outlet is provided at the tapered end of the base section and includes a secondary closure member which is movable to an open position to permit removal of the particulate material from the vessel;

a closure member for closing the opening in the top panel;

a seal for sealing the opening when closed by the closure member;

a gas duct in fluid connection with the vessel for supplying gas to or removing gas from the vessel; and a valve for closing the gas duct to seal the container for transit or storage.

2. The bulk storage container of claim 1 further comprising a secondary outlet configured to permit air to be purged from the vessel when a gas is supplied into the vessel via the gas duct.

3. The bulk storage container of claim 2 wherein the secondary outlet comprises a unidirectional valve.

4. A bulk material handling assembly from transferring particulate material to a storage container for transport or storage, the assembly comprising:

a bulk storage container for particulate material comprising:

a vessel having an inner wall defining a containment volume for particulate material;

an opening for receiving said particulate material into the vessel;

a closure member for closing the opening;

a seal for sealing the opening when closed by the closure member;

a gas duct in fluid connection with the vessel for supplying gas to or removing gas from the vessel; and a valve for closing the gas duct to seal the container for transit or storage;

a feeder vessel from which the container is filled, the feeder vessel comprising a hopper having an opening in a base of the hopper and an entry port configured to permit the hopper to be filled with particulate material entrained within a carrier gas flow;

a filling duct for connecting the feeder vessel to the container;

sealing means configured to provide a seal between the filling duct and the container about the opening of the container to prevent the release of particulate material from the opening during filling;

a vacuum source connected to the gas duct of the container to remove gas from the sealed container during filling and to evacuate gas from the container when the opening is closed and sealed for transit or storage;

a gas extraction duct in fluid connection with an interior of the hopper and connected to the vacuum source to promote the flow of gas into the hopper; and a dust extractor comprising:

an annular collar surrounding the filling duct such that a void is defined between an inner wall of the collar and the filling duct;

a dust extraction duct in fluid connection with the void between said filling duct and said inner wall of said collar and connected to the vacuum source to facilitate the application of a vacuum to said void; and a valve arrangement configured to selectively switch the application of said vacuum between the gas extraction duct in fluid connection with the interior of the hopper and the dust extraction duct connected to the annular collar such that the vacuum is applied to the collar and not the hopper when the particulate material is being transferred from the hopper to the container via the filling duct.

5. The bulk material handling assembly of claim 4 wherein the valve arrangement comprises a first valve arranged to close the fluid connection between the hopper and the vacuum source and a second valve arranged to close the fluid connection between the annular collar and the vacuum source.

* * * * *